US010415292B2

(12) United States Patent
Hammerer

(10) Patent No.: US 10,415,292 B2
(45) Date of Patent: Sep. 17, 2019

(54) FURNITURE HINGE

(71) Applicant: Julius Blum GmbH, Hoechst (AT)

(72) Inventor: Andre Hammerer, Alberschwende (AT)

(73) Assignee: JULIUS BLUM GMBH, Hoechst (AT)

( * ) Notice: Subject to any disclaimer, the term of this patent is extended or adjusted under 35 U.S.C. 154(b) by 57 days.

(21) Appl. No.: 15/924,627

(22) Filed: Mar. 19, 2018

(65) Prior Publication Data

US 2018/0209193 A1 Jul. 26, 2018

Related U.S. Application Data

(63) Continuation of application No. PCT/AT2016/060052, filed on Sep. 8, 2016.

(30) Foreign Application Priority Data

Oct. 6, 2015 (AT) ..... A 649/2015

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/16* (2013.01); *E05D 7/0407* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 4,724,578 A 2/1988 Toyama
4,776,061 A 10/1988 Franco
(Continued)

FOREIGN PATENT DOCUMENTS

CN 2610036 4/2004
CN 103080453 5/2013
(Continued)

OTHER PUBLICATIONS

International Search Report dated Nov. 17, 2016 in International (PCT) Application No. PCT/AT2016/060052.
(Continued)

*Primary Examiner* — Chuck Y Mah
(74) *Attorney, Agent, or Firm* — Wenderoth, Lind & Ponack, L.L.P.

(57) ABSTRACT

A furniture hinge includes a first fitting portion, a second fitting portion, and a hinge lever connecting the first fitting portion and the second fitting portion. An adjustment screw adjusts a position of the furniture hinge relative to the furniture carcass and/or the movable furniture part, and the adjustment screw is actuable by a screwdriver introduced into a recess. A spring device can move the furniture hinge from a predetermined angular position into a fully closed position and/or a fully open position. A control curve interacts with the spring device from the predetermined angular position into the fully closed position and/or the fully open position, and an intermediate portion allows the spring device to interact with the control curve. The intermediate portion has an opening flush with the recess of the hinge lever, so that the screwdriver can be introduced through the recess and through the opening of the intermediate portion.

13 Claims, 5 Drawing Sheets

(51) Int. Cl.

| | |
|---|---|
| ***E05D 3/16*** | (2006.01) |
| ***E05D 7/04*** | (2006.01) |
| ***E05F 1/12*** | (2006.01) |
| ***E05F 1/14*** | (2006.01) |
| ***E05F 3/18*** | (2006.01) |
| *E05D 7/10* | (2006.01) |

(52) U.S. Cl.
CPC ..... *E05F 1/1253* (2013.01); *E05F 1/14* (2013.01); *E05F 3/18* (2013.01); *E05D 7/1061* (2013.01); *E05D 2003/166* (2013.01); *E05Y 2201/212* (2013.01); *E05Y 2201/474* (2013.01); *E05Y 2201/638* (2013.01); *E05Y 2800/292* (2013.01); *E05Y 2900/20* (2013.01)

(58) Field of Classification Search
CPC ..... E05Y 2201/21; E05Y 2201/256; E05Y 2201/264; E05Y 2201/266; E05Y 2201/638; E05F 5/006; E05F 5/02; E05F 5/10; E05F 5/027; E05D 11/1021; E05D 5/1042; E05D 5/105; E05D 5/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 5,058,238 | A | 10/1991 | Lautenschläger | |
| 8,424,161 | B2 * | 4/2013 | Sutterlutti | E05F 5/006 16/286 |
| 8,601,644 | B1 * | 12/2013 | Chen | E05F 5/006 16/286 |
| 2011/0019946 | A1 * | 1/2011 | Krammer | E05F 5/006 384/20 |
| 2011/0083299 | A1 * | 4/2011 | Krudener | E05D 7/0407 16/319 |
| 2011/0225768 | A1 * | 9/2011 | Haemmerle | E05D 3/16 16/49 |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2013/0167323 | A1 | 7/2013 | Brunnmayr | |
| 2015/0218863 | A1 * | 8/2015 | Cooper | E05D 3/14 16/235 |
| 2015/0330128 | A1 | 11/2015 | Ng | |
| 2015/0337577 | A1 * | 11/2015 | Peer | E05D 3/02 312/326 |
| 2015/0361709 | A1 * | 12/2015 | Stuke | E05D 3/16 16/352 |
| 2016/0153224 | A1 * | 6/2016 | Salice | E05D 3/16 16/52 |
| 2017/0152693 | A1 * | 6/2017 | Chen | E05F 5/006 |
| 2018/0087307 | A1 * | 3/2018 | Hammerer | E05D 3/06 |

FOREIGN PATENT DOCUMENTS

| | | |
|---|---|---|
| CN | 203856311 | 10/2014 |
| DE | 28 36 020 | 3/1979 |
| EP | 0 242 476 | 10/1987 |
| GB | 2 004 320 | 3/1979 |
| JP | 55-26302 | 2/1980 |
| JP | 62-154173 | 9/1987 |
| JP | 62-169169 | 10/1987 |
| JP | 1-171879 | 12/1989 |
| JP | 3-208977 | 9/1991 |

OTHER PUBLICATIONS

Search Report dated Jun. 20, 2016 in Austrian Application No. A 649/2015, with English translation.

* cited by examiner

FURNITURE HINGE

BACKGROUND OF THE INVENTION

The present invention relates to a furniture hinge, including:

- a first fitting portion to be fixed to a furniture carcass,
- a second fitting portion to be fixed to a movable furniture part,
- at least one hinge lever by which the first fitting portion and the second fitting portion are hingedly connected to one another, wherein the hinge lever has at least one recess for introducing a screwdriver,
- at least one adjustment screw for adjusting a position of the furniture hinge relative to the furniture carcass and/or relative to the movable furniture part, wherein the adjustment screw is configured to be actuable by the screwdriver being introduced into the recess,
- at least one spring device for moving the furniture hinge from a predetermined angular position into the fully closed position and/or into the fully open position,
- a control curve which interacts with the spring device from the predetermined angular position into the fully closed position and/or into the fully open position,
- an intermediate portion by which the spring device interacts with the control curve.

By rotating an adjustment screw of the furniture hinge, the movable furniture part, in the mounted condition, can be adjusted in a depth direction (i.e. in a direction of the depth of the furniture carcass), in a lateral direction or also in a height direction, so that the furniture part can be duly moved and optimally adjusted relative to the furniture doors of adjacent cabinets. When the furniture hinge is configured as a multiple-joint hinge having at least five or more hinge axes, the movable furniture part can assume an opening angle of at least 150°, preferably of at least 170°, relative to a front face of the furniture carcass. The adjustment screw is thereby accessible for a screwdriver via a recess arranged in a hinge lever. Direct access to the adjustment screw is, however, frequently hindered or even prevented by the arrangement of a spring device by which the furniture hinge can be moved into the closed and/or open end position.

DE 28 36 020 A1 shows a furniture hinge having a control curve to which a thrust lever which is pressurized by a compression spring engages.

It is an object of the present invention to propose a furniture hinge of the type mentioned in the introductory part, providing an improved access to the adjustment screw.

This is accomplished by the features as recited in claim 1. Further advantageous embodiments of the invention are defined in the dependent claims.

According to the invention, it is thus provided that the intermediate portion, in at least one relative position of the hinge lever, has an opening being flush relative to the recess of the hinge lever, so that the screwdriver can be introduced through the recess of the hinge lever and through the opening of the intermediate portion in order for the adjustment screw to be actuated.

In other words, the spring device does not directly act onto the control curve, but indirectly via the intermediate portion which, in at least one relative position of the hinge lever, preferably in all relative positions, has an opening being flush relative to the recess of the hinge lever for introducing a screwdriver. The screwdriver can thereby be passed through the recess of the hinge lever as well through the opening of the intermediate portion and can be positioned on the head of the adjustment screw, so that the adjustment screw can be rotated by the introduced screwdriver.

Instead of a screwdriver, it is, however, also possible to use any other suitable tool for rotating the adjustment screw, such as for example a hex-wrench. It is also to be noted that said intermediate portion can not only have a one-piece configuration, but also a two-part or a multi part configuration.

BRIEF DESCRIPTION OF THE DRAWINGS

Further details and advantages of the invention will be explained in the following description of figures, in which.

DETAILED DESCRIPTION OF THE PREFERRED EMBODIMENT

Figure 1:
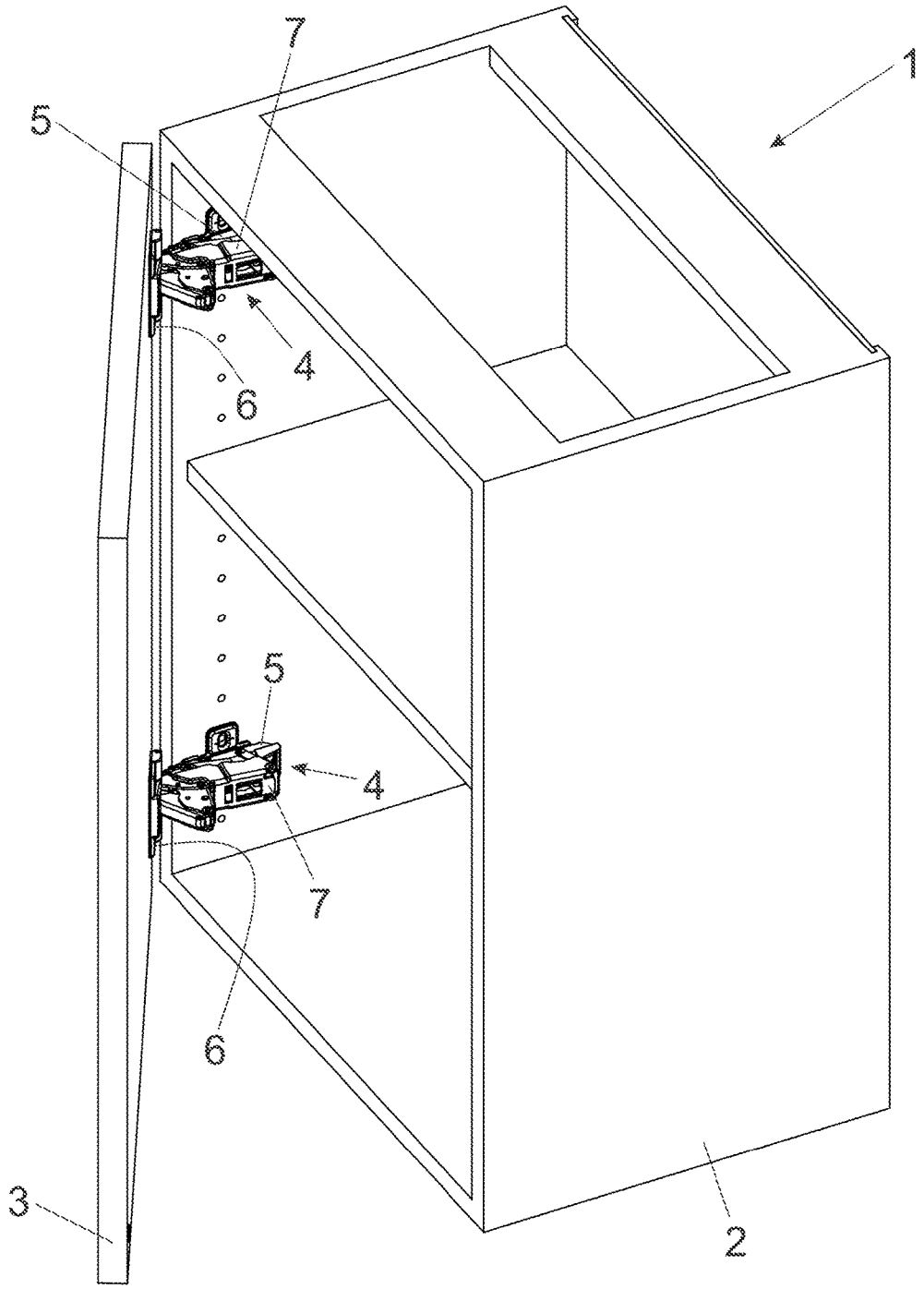
FIG. 1 shows a perspective view of an item of furniture with a furniture carcass and furniture part which is movable thereto.

FIG. 1 shows a perspective view of an item of furniture 1 with a furniture carcass 2, wherein a movable furniture part 3 in the form of a door is pivotally mounted about a vertically extending axis relative to the furniture carcass 2 by way of furniture hinges 4. The furniture hinges 4 each include a first fitting portion 5—preferably with a hinge arm 5*a* (FIG. 2*a*)—to be fixed to the furniture carcass 2 and a second fitting portion 6 to be fixed to the movable furniture part 3. In the shown embodiment, the furniture hinge 4 is configured as a wide-angle hinge having a maximum opening angle of approximately 170°, wherein provided is a hinge lever 7 coupled to a movement of the hinge 4, the hinge lever 7 performs a relative movement both to the first fitting portion 5 and to the second fitting portion 6 upon a movement of the hinge 4.

Figure 2:
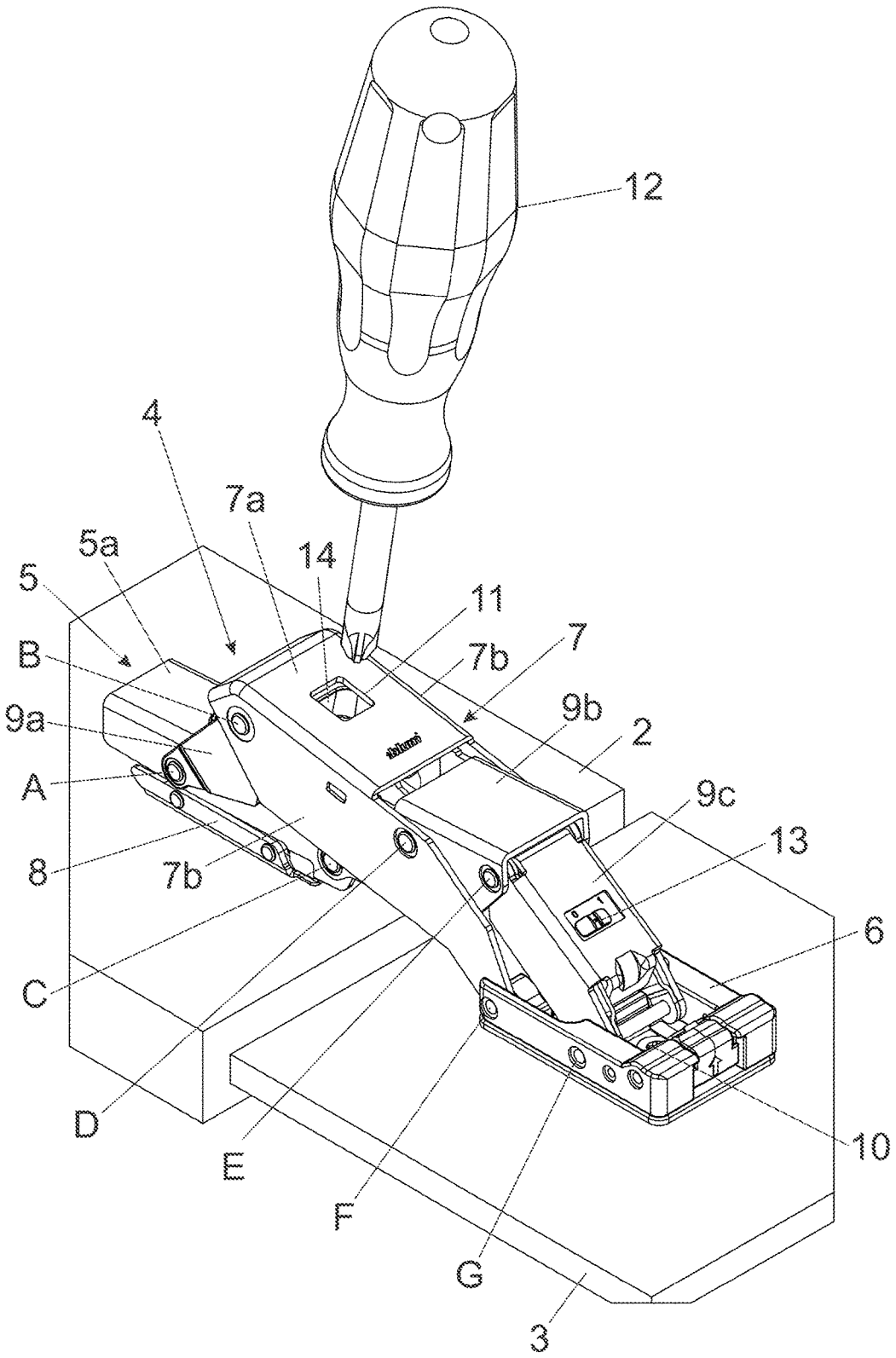
FIG. 2 shows the furniture hinge in an approximately half-open position.

FIG. 2 shows the furniture hinge 4 in an approximately half-open position, so that the movable furniture part 3 assumes an opening angle of about 90° relative to the front face of the furniture carcass 2. The furniture hinge 4 includes a first fitting portion 5 with a hinge arm 5*a* configured to be connectable without the aid of a tool and detachable without the aid of a tool relative to a base plate 8 to be attached to the furniture carcass 2 by way of a (not shown) snap mechanism. The second fitting portion 6 is to be fixed by fastening means, preferably by at least one screw 10, to the movable furniture part 3. In the shown embodiment, the two fitting portions 5 and 6 are pivotally connected to one another by four hinge levers 9*a*, 7, 9*b*, 9*c* and seven hinge axes A, B, C, D, E, F, G. The hinge lever 7 includes, at least over a region, a U-shaped profile having a central limb 7*a* and two side limbs 7*b* protruding transversely from the central limb 7*a*, wherein the central limb 7*a* of the hinge lever 7 has a window-shaped recess 11 for introducing a screwdriver 12. Visible is also an intermediate portion 14 arranged within the U-shaped profile of the hinge lever 7, wherein the intermediate portion 14, in the shown relative position of the hinge lever 7, forms an opening 20 (FIG. 3) which is flush relative to the recess 11 of the hinge lever 7, so that the screwdriver 12 can be introduced through the recess 11 of the hinge lever 7 and through the opening 20 of the intermediate portion 14 in order for the adjustment screw 17 (FIG. 3) to be actuated for adjusting a position of the furniture hinge 4 relative to the furniture carcass 2 and/or relative to the movable furniture part 3. A damping device 19 (FIG. 3) is integrated into the hinge lever 9*c* by which a relative movement of the two fitting portions 5, 6 can be dampened to one another. Moreover, the furniture hinge 4, preferably the hinge lever 9*c*, has a switch 13 configured to be operated by a person. The switch 12 has a first switching position and at least one second switching position, wherein in the first switching position of the switch 13, a damping power of the damping device 19 is deactivated or limited, and wherein in the second switching position of the switch 13, the damping power of the damping device 19 is activated.

Figure 3:
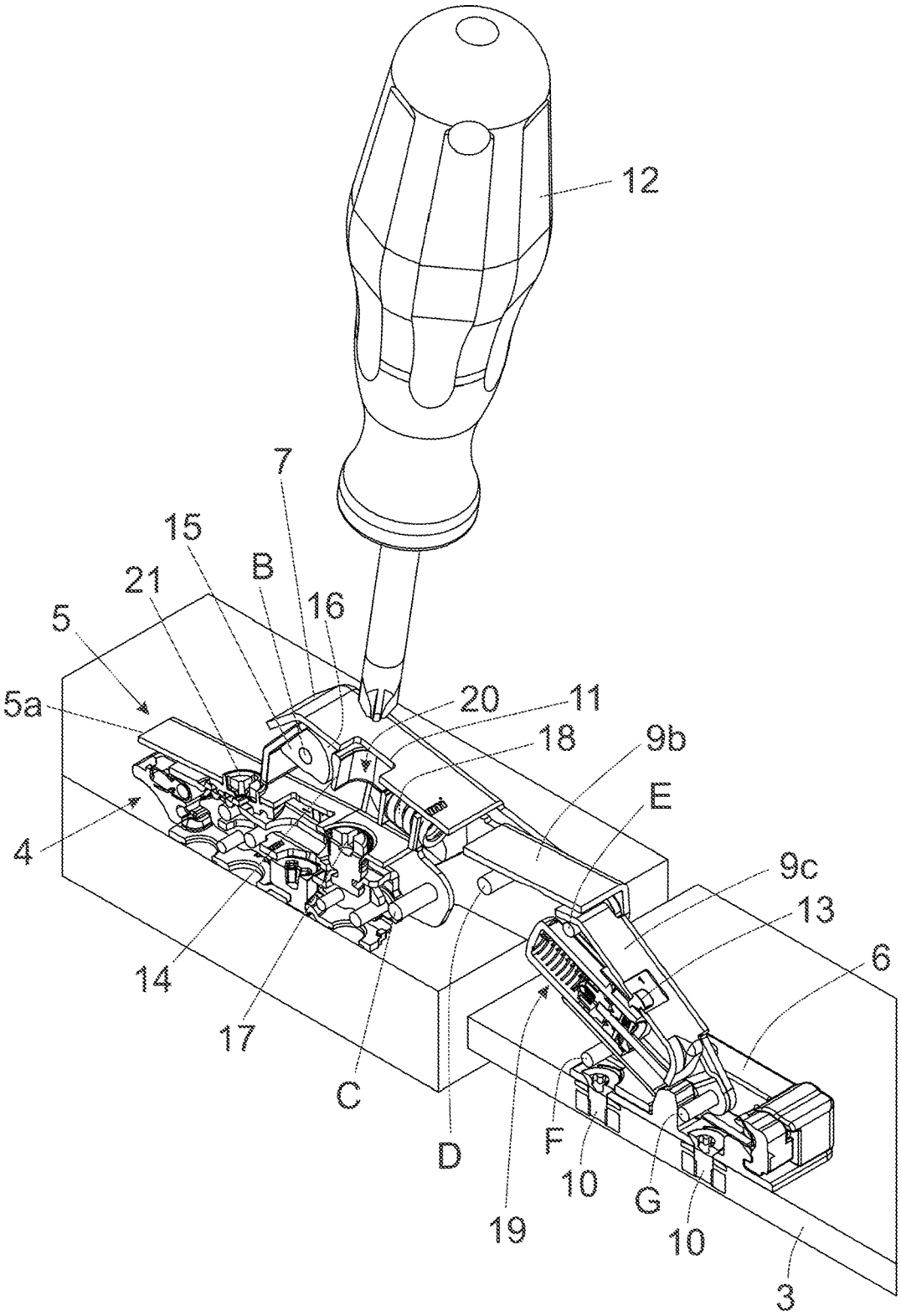
FIG. 3 shows the furniture hinge in a cross-section, wherein an adjustment screw is to be actuated by a screwdriver.

FIG. 3 shows the furniture hinge 4 in a cross-section. The movement of the hinge lever 7 is motionally coupled to a movement of the hinge 4, so that the hinge lever 7 performs a relative movement to the first fitting portion 5 as well to the second fitting portion 6 upon a movement of the hinge 4. A spring device 18 (preferably a helical spring configured as a compression spring) is integrated into the hinge lever 7, wherein the furniture hinge 4, from a predetermined angular position, can be moved into the fully closed position and/or into a fully open position by the spring device 18, wherein a convex control curve 16, from the predetermined angular position towards the fully closed position and/or into a fully open position, interacts with the spring device 18. In the shown embodiment, the control curve 16 is arranged or formed on a control cam 14 pivotally mounted on the hinge axis B, the control cam 14 is motionally coupled to a movement of the hinge 4. By rotating an adjustment screw 17, the first fitting portion 5 (and therewith the movable furniture part 3) can be adjusted relative to the furniture carcass 2 in a lateral direction.

In order to enable an actuation of the adjustment screw 17 in an open position of the furniture hinge 4, the intermediate portion 14 is provided with an opening 20, the main longitudinal direction of which, in the shown relative position of the hinge lever 7, extends substantially coaxially relative to the main longitudinal axis of the adjustment screw 17 as well as to the main longitudinal axis of the recess 11. In this way, the screwdriver 12 can be passed through the recess 11 of the hinge lever 7 as well through the opening 20 of the intermediate portion 14 and can be positioned on the head of the adjustment screw 17, so that the adjustment screw 17 can be rotated by turning the screwdriver 12. Moreover, mounted to the first fitting portion 5 is a further adjustment screw 21 by which the first fitting portion 5 can be adjusted in a depth direction relative to the furniture carcass 2.

The damping device 19, for example, can be configured as a linear damper with a hydraulic piston-cylinder-unit, which, at the end of the closing movement of the furniture hinge 4, can be acted upon by an inner side of the hinge lever 9*b* with a force, so that the movement of the hinge 4, from the predetermined angular position towards the fully closed position, can be decelerated by the damping device 19. By an adjustment of the switch 13, the damping power of the damping device 19 can be deactivated or limited.

Figure 4:
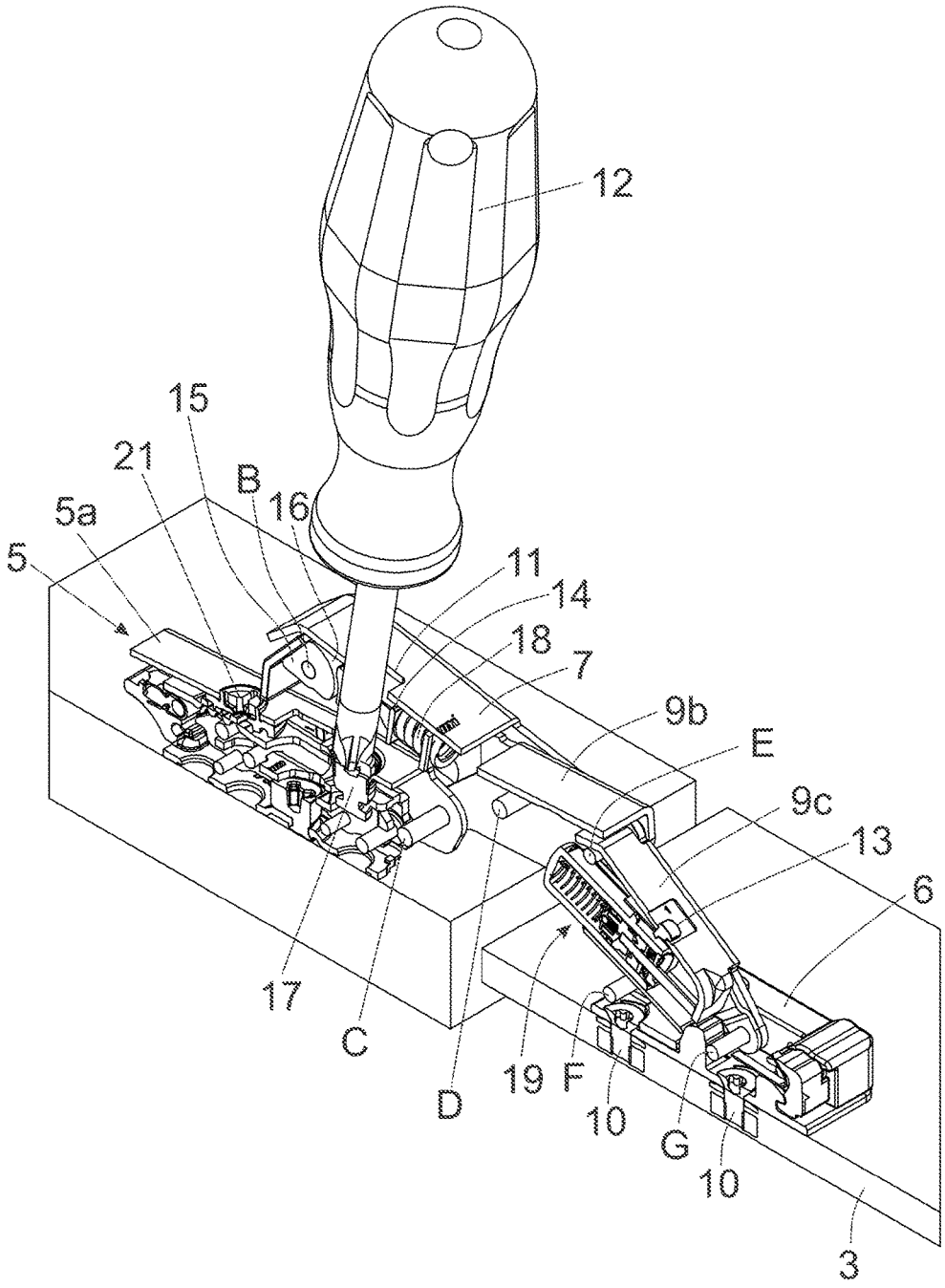
FIG. 4 shows the furniture hinge according to FIG. 3 with a screwdriver being positioned on the adjustment screw.

FIG. 4 shows the furniture hinge 4 in a cross-section, wherein the screwdriver 12 has been passed through the recess 11 of the hinge lever 7 and through the opening 20 of the intermediate portion 14 and has been placed on the head of the adjustment screw 17, so that the adjustment screw 17 can be rotated. Thus, the intermediate portion 14 effectively acts as a force-deflection device, wherein the intermediate portion 14 interacts with the spring device 18 on the one hand and with the control curve 16 of the pivotally mounted control cam 15 on the other hand.

Figure 5A:
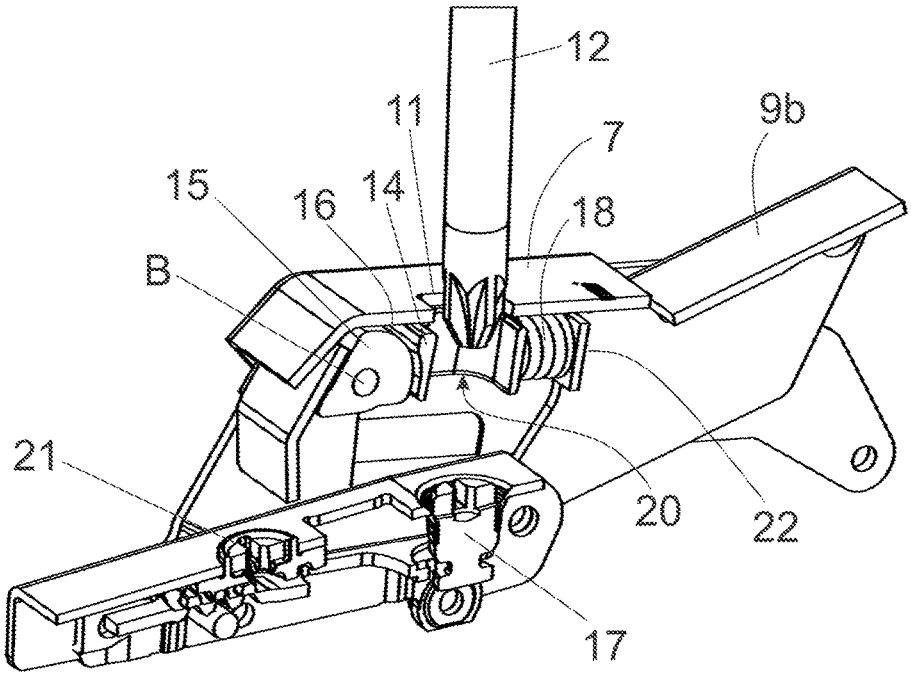
FIG. 5*a*, 5*b* show a partial section of the furniture hinge in a cross-section and an exploded view of the furniture hinge.

FIG. 5*a* shows a partial section of the furniture hinge 4, wherein the recess 11 and the opening 20 of the intermediate portion 14, in the shown relative position of the hinge lever 7, are aligned flush with one another, so that the adjustment screw 17 can be rotated by the introduced screwdriver 12. In the shown relative position, in which the adjustment screw 17 can be actuated, the longitudinal axis of the screwdriver 12 and the longitudinal axis of the adjustment screw 17 are arranged substantially coaxially relative to one another.

Figure 5B:
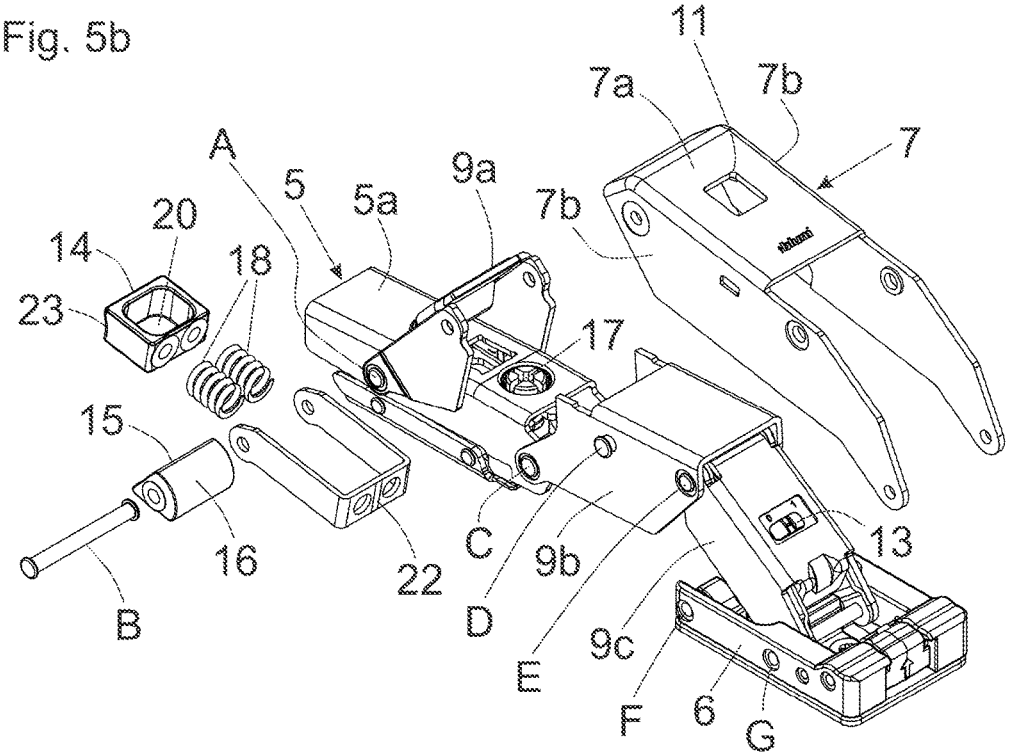

FIG. 5*b* shows the furniture hinge 4 in an exploded view. The spring device 18, in the shown embodiment, consists of two compression springs which are switched in parallel relationship to one another and which are supported on a spring bearing 22 on the one hand and on the intermediate portion 14 on the other hand. The spring bearing 22, together with the control cam 15, are pivotally mounted about the hinge axis B. The intermediate portion 14, for example, can be configured as a sleeve which preferably has an angled cross-sectional area. The intermediate portion 14, for directly resting against the control curve 16, has a counter-contour 23 which includes a concave portion at least over a region, the concave portion is configured complementary to the convex control curve 16. Accordingly, the control curve 16 and the counter-contour 23 of the intermediate portion 14, at least over a region, have complementary contours or countercurrent forms, respectively, in relation to one another, so that the control curve 16 and the counter-contour 23 lie flat on each other over a region. In this way, the occurring forces are distributed over a larger area, wherein point contacts or line contacts with high pressing forces are prevented. The hinge lever 7, at least over a region, is formed as a U-shaped profile having a central limb 7*a* and two side limbs 7*b* protruding transversely from the central limb 7*a*, wherein the recess 11 for introducing the screwdriver 12 is formed in the central limb 7*a* of the hinge lever 7. In at least one relative position of the hinge lever 7, which corresponds approximately to the half-open and/or fully open position of the movably-mounted furniture part 3 in the mounted condition of the furniture hinge 4, the recess 11 of the hinge lever 7 and the opening 20 of the intermediate portion 14 are aligned with one another, so that the screwdriver 12 can be passed through the recess 11 of the hinge lever 7 and through the opening 20 of the intermediate portion 14 in order for the adjustment screw 17 to be rotated.

The invention claimed is:

1. A furniture hinge, including:

a first fitting portion to be fixed to a furniture carcass, a second fitting portion to be fixed to a movable furniture part, at least one hinge lever by which the first fitting portion and the second fitting portion are hingedly connected to one another, wherein the hinge lever has at least one recess for introducing a screwdriver, at least one adjustment screw for adjusting a position of the furniture hinge relative to the furniture carcass and/or relative to the movable furniture part, wherein the adjustment screw is configured to be actuable by the screwdriver being introduced into the recess, at least one spring device for moving the furniture hinge from a predetermined angular position into the fully closed position and/or into the fully open position, a control curve which interacts with the spring device from the predetermined angular position into the fully closed position and/or into the fully open position, an intermediate portion by which the spring device interacts with the control curve, wherein the intermediate portion, in at least one relative position of the hinge lever, has an opening being flush relative to the recess of the hinge lever, so that the screwdriver can be introduced through the recess of the hinge lever and through the opening of the intermediate portion in order for the adjustment screw to be actuated.

2. The furniture hinge according to claim 1, wherein the opening of the intermediate portion and the recess of the hinge lever are aligned flush with one another in all relative positions of the hinge lever.

3. The furniture hinge according to claim 1, wherein the intermediate portion directly rests against the spring device on the one hand and directly rests against the control curve on the other hand.

4. The furniture hinge according to claim 1, wherein the intermediate portion is configured as a sleeve.

5. The furniture hinge according to claim 1, wherein the hinge lever, at least over a region, includes a U-shaped profile having a central limb and two side limbs protruding transversely from the central limb, wherein the recess is formed in the central limb of the hinge lever.

6. The furniture hinge according to claim 5, wherein the spring device is accommodated within the U-shaped profile of the hinge lever.

7. The furniture hinge according to claim 1, wherein the hinge lever is pivotally connected to the first fitting portion via at least one hinge axis, wherein the control curve is formed on a control cam pivotally mounted on said hinge axis.

8. The furniture hinge according to claim 1, wherein the spring device includes at least one helical compression spring.

9. The furniture hinge according to claim 1, wherein the adjustment screw is rotatably mounted on the first fitting portion.

10. The furniture hinge according to claim 1, wherein the first fitting portion, in the mounted position, can be adjusted in a lateral direction upon rotating the adjustment screw.

11. The furniture hinge according to claim 1, wherein a further adjustment screw is provided by which the first fitting portion, in the mounted position, can be adjusted in a depth direction.

12. The furniture hinge according to claim 1, wherein the first fitting portion includes a hinge arm, wherein the adjustment screw is rotatably arranged on the hinge arm.

13. The furniture hinge according to claim 1, wherein the furniture hinge is configured as a wide-angle hinge having at least seven hinge axes.

* * * * *